United States Patent [19]

Berfield et al.

[11] Patent Number: 4,462,137

[45] Date of Patent: Jul. 31, 1984

[54] ELECTRIC VACUUM CLEANER

[75] Inventors: Robert C. Berfield, Jersey Shore; Richard M. Fegan, Montoursville, both of Pa.

[73] Assignee: Shop-Vac Corporation, Williamsport, Pa.

[21] Appl. No.: 455,312

[22] Filed: Jan. 3, 1983

[51] Int. Cl.[3] ..... A47L 7/00

[52] U.S. Cl. ..... 15/353; 15/320; 15/354; 15/410; 15/413

[58] Field of Search ..... 15/320, 321, 353, 413, 15/354, 355, 356, 410, 351

[56] References Cited

U.S. PATENT DOCUMENTS

| | | | |
|---|---|---|---|
| 2,296,077 | 9/1942 | Yonkers | 15/354 |
| 2,635,278 | 4/1953 | Belknap | 15/320 X |
| 2,841,812 | 7/1958 | Lachowicz | 15/355 |
| 3,344,460 | 10/1967 | Nordeen | 15/351 |
| 3,408,673 | 11/1968 | Oxel | 15/320 X |
| 3,755,850 | 9/1973 | Porter | 15/320 |
| 3,939,527 | 2/1976 | Jones | 15/320 X |
| 3,974,541 | 8/1976 | Silvis et al. | 15/320 |
| 4,114,231 | 9/1978 | Nauta | 15/321 |
| 4,413,372 | 11/1983 | Berfield | 15/353 X |

*Primary Examiner*—Chris K. Moore

*Attorney, Agent, or Firm*—Ostrolenk, Faber, Gerb & Soffen

[57] ABSTRACT

The electric vacuum cleaner here disclosed includes a main motor housing supporting a bypass type motor within it. The motor housing is separably connected to and swingable about the materials collecting tank beneath it. A tube projecting above the cover of the tank and extending laterally over the cover defines the air flow communication between the tank and depending side sections of the motor housing which meet and are releasably attached to the ends of the tube. The tube also defines the swing axis of the motor housing. Detents control this swinging. A resilient cuff over the motor in the housing separates the fan motor bypass cooling air inlet and outlet from each other and from the main suction fan outlet and also separates all of these from the main suction fan inlet, while also defining respective flow paths communicating with inlets and outlets from the motor housing. A series of baffles between the main suction fan outlet and the outlet for this air from the motor housing elongates the path of this air, redirects it and damps its vibration for reducing noise. An inlet airflow regulator selectively recirculates some of the air from the main fan outlet back to the main fan inlet which correspondingly adjusts inlet suction in the tank. The bearings for the wheels under the tank at the air inlet support the wheels eccentrically on the bearings, whereby rotation of the orientations of the bearings adjusts the height of the air inlet.

26 Claims, 18 Drawing Figures

374
372
370
418
420
420
422
290
320
292
410
412
324
326
10
406
404
334
262
402
250
210
401
263
272
339
350
374
214
352
350
356
220
218
212
228
249
242
239
228
224
221
238
192
222
130
190
160
150
150
184
238
166
236
160
168
124
239
162
202
174
128
154
32
126
46
178
72
75
78
72
204
44
94
20
140
110
48
75
152
96
70
74
86
90
92
40
73
71
86
74

FIG. 5
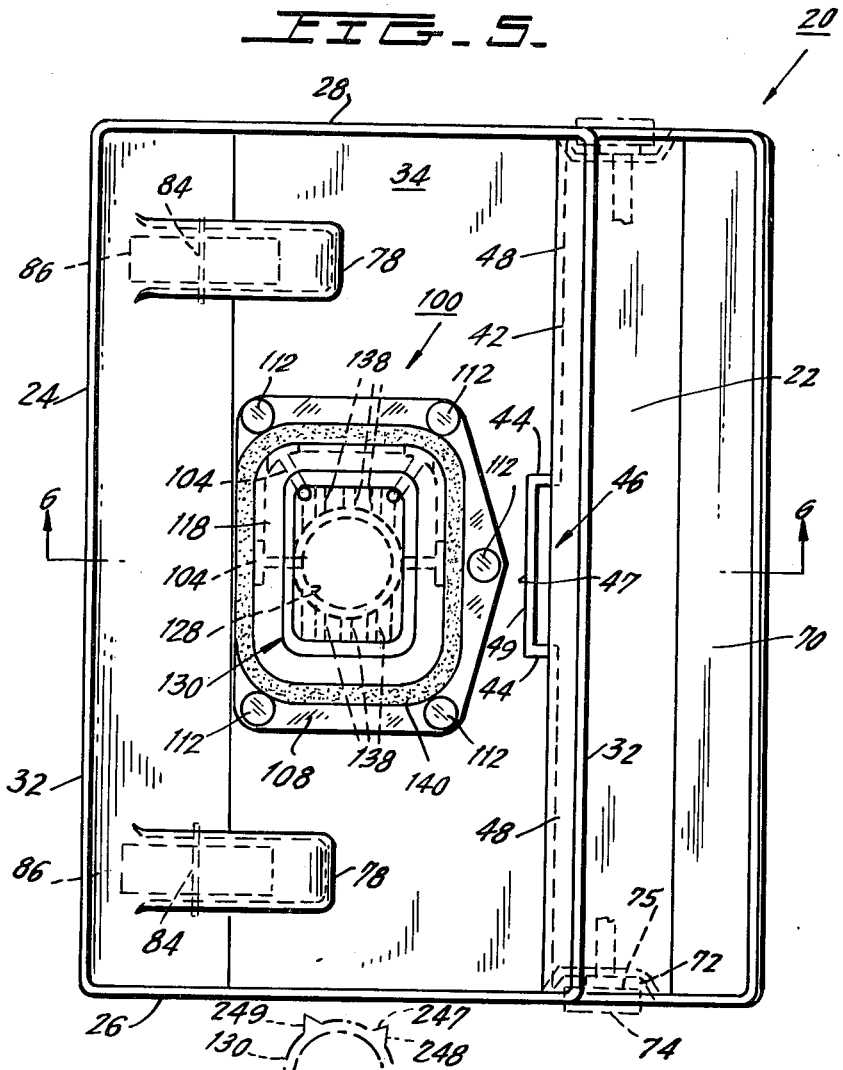
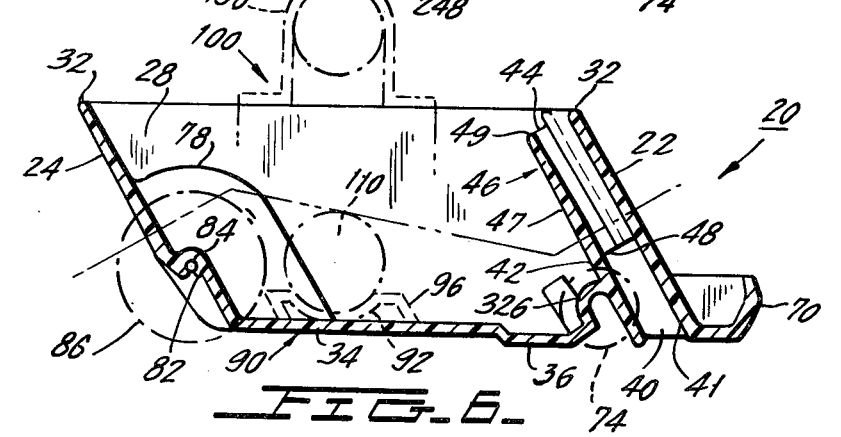
FIG. 6

LOW
MED
HIGH
MED 334
220
210
214
228
226
228
239
239
241
241
224
224
221
221
174
174
168
160
166
150
162
162
187
204
154
167
152
230
248
130
234
234
220
210
238
238
20
32
46
24
100
46
26
78
104
46
78
28
22
44
44
22
75
110
48
48
75
70
94
70
96
74
86
34
71
73
92
90
40
52
86
74

ELECTRIC VACUUM CLEANER

BACKGROUND OF THE INVENTION

The present invention relates to an upright-type electric vacuum cleaner which is able to suction dry particulate materials, wet materials and liquids.

Electric vacuum cleaners of the above type have typically been tank-type vacuum cleaners, where the intake to the tank has been through a hose which is stretched to the area to be suctioned. It is desirable to combine the dry and wet pickup functions in an upright-type electric vacuum cleaner. One successful effort in combining these functions in an upright vacuum cleaner is illustrated in U.S. Pat. No. 4,334,337. In this vacuum cleaner, the tank for collecting the materials is located at the bottom of the upright vacuum cleaner and it is easily separated from the motor housing for freeing the tank to be moved to where its contents may be disposed of and it may be cleaned. The above-noted electric vacuum cleaner should desirably be made even simpler and the present invention is directed toward simplifying an upright-type electric vacuum cleaner having the features discussed above.

BRIEF DESCRIPTION OF THE INVENTION

It is the primary object of the present invention to provide an upright-type electric vacuum cleaner with a tank for collected materials which is easily separable from and attachable to the housing for the blower motor of the vacuum cleaner.

It is another object of the present invention to provide such an electric vacuum cleaner which is adapted for providing a good air path between the collecting tank and the motor housing, and which also firmly attaches the tank to the motor housing, although the motor housing pivots with respect to the tank during use.

Yet another object of the invention is to provide such an electric vacuum cleaner which has relatively quiet operation, and particularly where the motor housing tends to damp noise and vibration generated by the electric vacuum cleaner motor.

A further object of the invention is to permit adjustment of the height of the inlet to the electric vacuum cleaner over the surface being suctioned.

A still further object of the invention is to regulate the air flow rate into the vacuum cleaner.

The electric vacuum cleaner according to the present invention includes an upstanding motor housing for containing a bypass-type blower motor. The bypass-type blower motor has a main suction fan, which is preferably a centrifugal fan, and has a separate cooling fan for blowing cooling air over the motor. The motor is in a casing which is, in turn, in the motor housing.

The collecting tank for collecting materials rides along the surface to be suctioned. The motor housing pivots or swivels with respect to the tank as the operator moves the vacuum cleaner back and forth. The tank has an inlet on its underside for suctioning the materials into the tank. The tank is connected with the motor housing by means of first connecting means extending up above the tank cover and second connecting means defined in the motor housing and connected with the first connecting means. The connecting means extending up from the tank comprises a tube which extends laterally of the vacuum cleaner. The motor housing has lower side sections which communicate with the ends of the tube and has selectively movable means for locking to the tube or for separating from and unlocking from the tube for selectively connecting and disconnecting the motor housing and the tube. The tube also defines the airflow communication from the tank into the motor housing.

The cover of the tank and the bottom of the motor housing are respectively rounded in a complementary fashion so that the motor housing may pivot over the correspondingly rounded surface section of the tank cover. The tube sits in a depression in the tank cover and the motor housing also sits in that depression which is correspondingly rounded to the motor housing. Detent means cooperate between the tube and the motor housing for detenting the motor housing at various tilt positions with respect to the tank, including a forward storage position, an intermediate use position and a tilt-back position.

Outlet from the tank to the tube leading to the motor housing is past a filter which is supported on a filter cage in the tank, so that the filter extends vertically through the tank.

The inlet into the tank is through a channel extending across the bottom of the tank and a passageway leading up from the channel toward the top cover of the tank, whereby materials entering the tank are blown toward the tank cover. The filter in the tank is surrounded by a baffle which extends down from the tank cover a distance so that the materials entering the tank from the entrance passageway are redirected to fall down in the tank and are prevented by the baffle from reaching the filter.

The motor housing contains the means which separate the various airflows to the main suction fan inlet, from the main suction fan outlet, to the motor cooling fan inlet and from the motor cooling fan outlet. The main suction fan inlet faces downwardly to draw air through the bottom of the motor housing and into the main suction fan. The motor casing sits on a platform in the motor housing which platform serves to seal the main fan inlet from the main fan outlet.

A resilient, vibration-absorbing cuff is positioned in the motor housing. The cuff defines a first chamber communicating between the cooling air inlet to the motor casing and a duct in the motor housing for supplying air to the cooling air inlet. The cuff also defines a separate second chamber communicating between the cooling air outlet from the motor casing and another duct in the motor housing for exit of heated cooling air. To separate the first and second chambers in the cuff, the cuff seals to the motor casing.

The outlet from the main suction fan communicates into the housing externally of the cuff. The air flowing from the main suction fan outlet flows around the outside of the cuff to an outlet duct from the motor housing which is spaced a distance from the main suction fan outlet. A series of spaced apart flow redirecting baffles arranged inside the motor housing and external to the cuff redirects the air flowing out of the main suction fan and defines a series of chambers through which that air flows. The redirection of the air, the provision of a number of chambers, the length of the path that the airflow from the main suction fan outlet must follow and the fact that that air also passes by the exterior of the resilient cuff together damp vibration, slow the velocity of the air and reduce the noise generated by the vacuum cleaner.

For adjusting the height of the inlet at the underside of the tank, the height of the wheels supporting the front of the tank with respect to the tank is adjusted. To this end, the wheels are supported on respective bearings which are mounted eccentrically to the tank. Rotation of the bearings around their eccentric mountings in turn adjusts the height of the wheels on the bearings and this, in turn, determines the height of the air inlet above the surface being suctioned. The rotation of the bearings is detented at a plurality of orientations. In one version of this detent, a plate, particularly the plate carrying a brush which moves materials to the inlet for being suctioned, presses on the bearings and the bearings are shaped to have detented orientations so that rotation of the bearings to selected orientations is possible against the resistance provided by the detent means.

Other objects and features of vacuum cleaner of the present invention will be apparent from the following description and accompanying drawings showing a preferred embodiment of the invention.

BRIEF DESCRIPTION OF THE DRAWINGS

FIG. 5 is a plan view of the tank of the vacuum cleaner;

FIG. 6 is a cross-sectional view of the tank along the lines 6—6 of FIG. 5;

FIG. 18 is an enlarged view of the air flow regulator also shown in FIG. 4.

DETAILED DESCRIPTION OF THE PREFERRED EMBODIMENT

The vacuum cleaner 10 according to the present invention is a complete assembly including the inlet, collecting tank for collected particulates and liquids, blow motor for sucking materials through the inlet and outlet for air.

Figures 1B, 4:
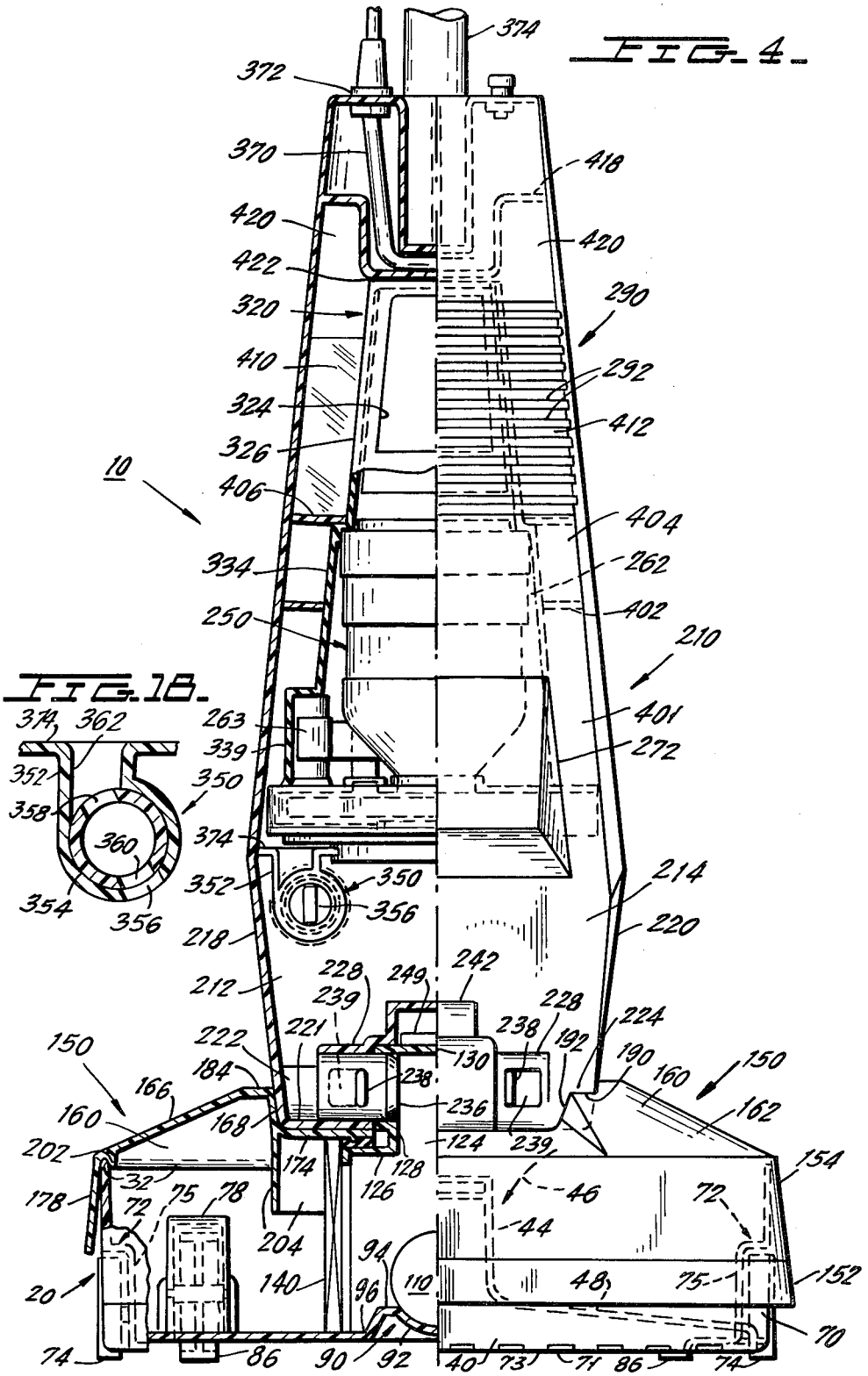
FIG. 4 is a front elevational view, partially cut away.
Figure 7:
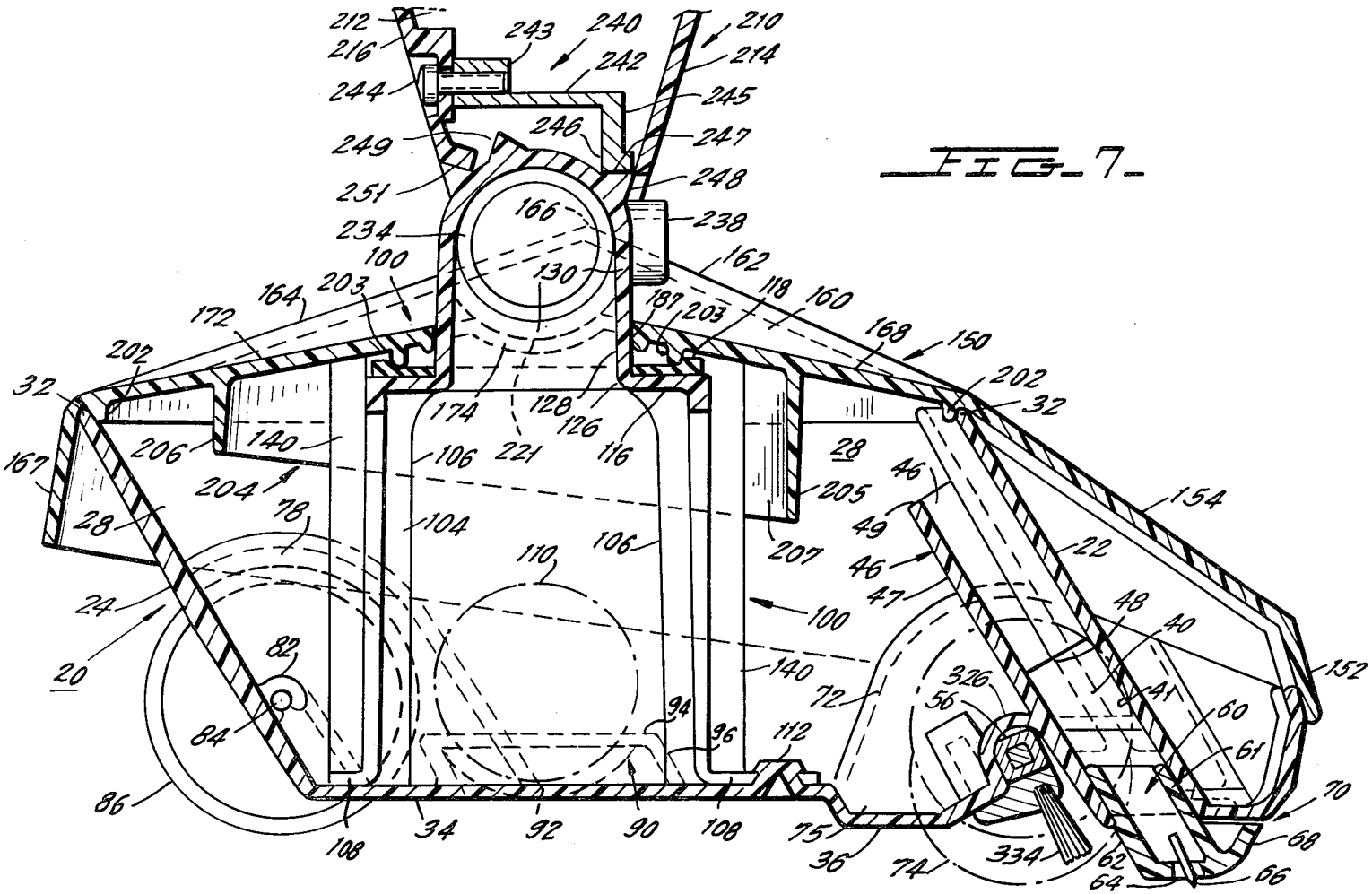
FIG. 7 is a cross-sectional view, also along the lines 6—6 in FIG. 5, showing the tank and cover assembled together.

Inlet to the vacuum cleaner is at the tank 20 seen in FIGS. 4, 5 and 7. The tank 20 is essentially an open top box. It has an upwardly, rearwardly inclined flat front wall 22 and a correspondingly inclined flat rear wall 24. The incline of the front wall thrusts the bottom of the tank forward with respect to the top of the tank, enabling the front of the vacuum cleaner to be moved partially under low furniture. The rear wall is correspondingly inclined to enable the entire tank to be molded as a single unit in a mold. The tank has opposite side walls 26 and 28. The top edge 32 of the tank 20 is of uniform height around the tank. The bottom of the tank is closed off by its bottom wall 34. Toward the front of the tank, the bottom wall is depressed at 36 down to the height of the inlet to the tank, which aids in supporting the inlet at the correct height on carpets.

Figure 12:
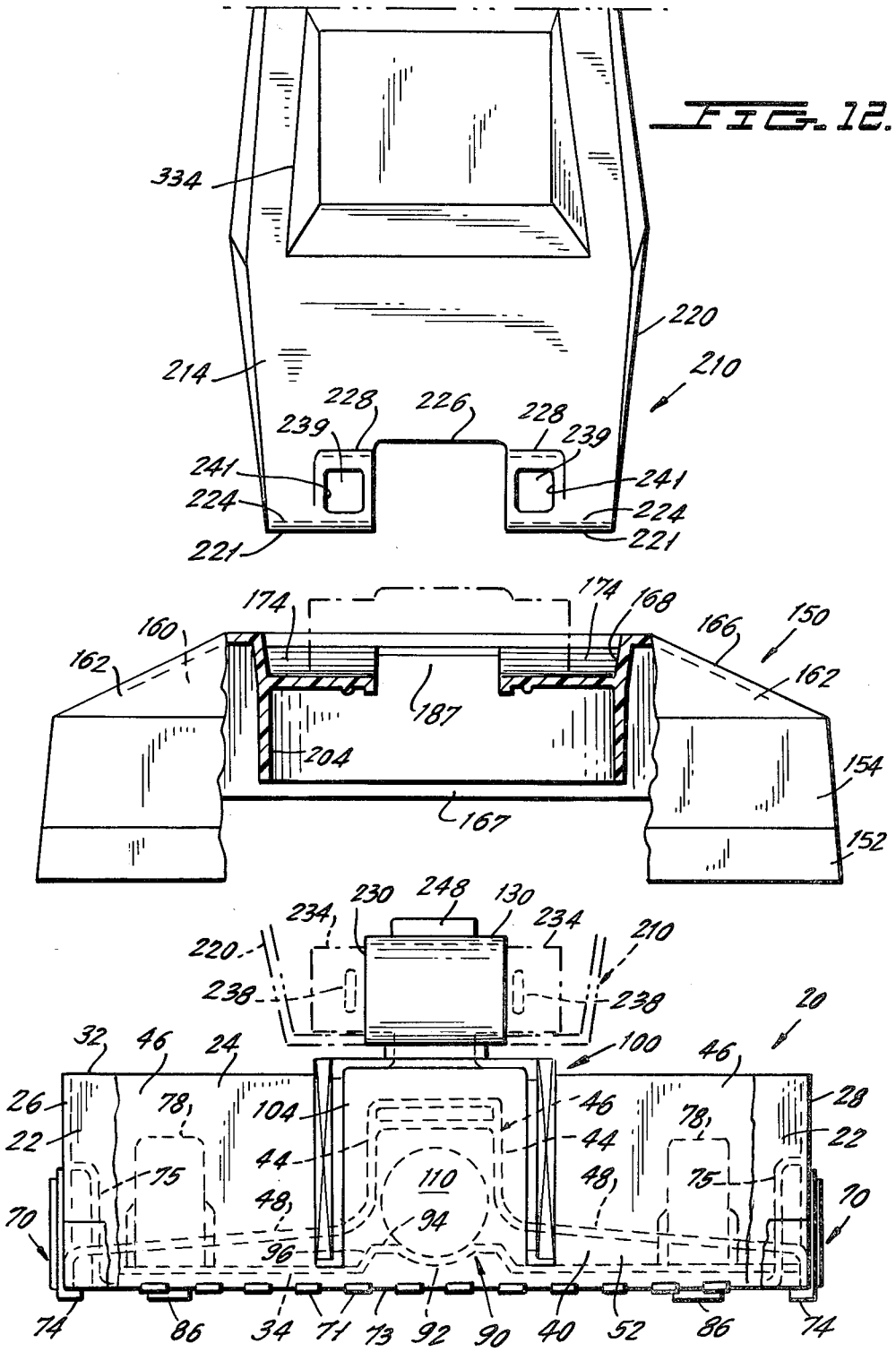
FIG. 12 is an exploded elevational view of the tank, tank cover and lower portion of the motor housing of the vacuum cleaner.
Figure 13:
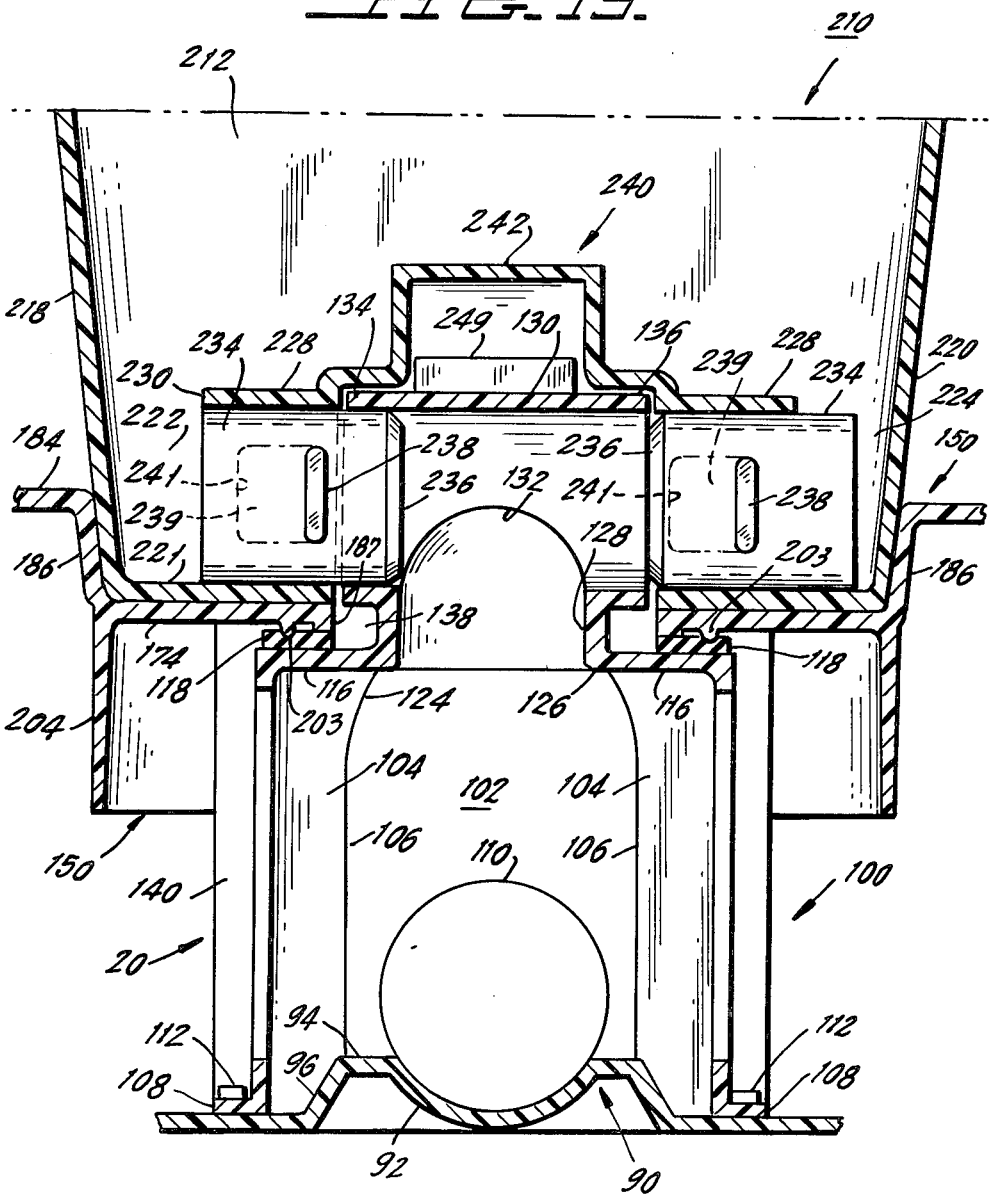
FIG. 13 is a fragmentary view of the central region of the elements mentioned above, assembled together.

The inlet to the tank is comprised of a channel 40 which is narrow in its front to back dimension between the front wall 22 of the tank and the rear wall 42 of the channel. The wall 42 parallels the front wall 22 and projects up from the bottom wall 34, 36 of the tank and extends across the tank between its side walls 26, 28. The channel 40 is the air inlet and suction pick-up for the vacuum cleaner. The channel 40 extends the full width of the tank, between the sides 26 and 28 and extends up from its entrance 41 at the bottom wall 36. There is a single centrally located entrance duct 46 from the channel 40 into the tank 20, also shown in FIGS. 4 and 12. The duct 46 is defined between the sharply inclined spaced apart, but gradually inclined together, walls 44, the front wall 22 of the tank 20 and the rear wall 47 of the duct to define a gradually narrowing cross-section for the duct 46 for the air and suctioned material.

Down near the inlet entrance 41, the walls 44 of the duct 46 merge into respective outwardly extending, top walls 48 of the channel 40. The walls 48 are gradually inclined downwardly toward the lateral side walls 26, 28 of the tank. The walls 48 are also inclined generally perpendicularly to the inclined walls 22, 42. Typicallly, the suction force in the inlet channel 40 diminishes moving away from the duct 46. To compensate for this, the walls 48 incline downwardly away from the duct 46, gradually reducing the cross-section of the channel 40 which correspondingly increases the suction force away from the duct 46, giving the inlet 41 substantially uniform suction force between the lateral side walls 26, 28 of the tank. The top edge 49 of the rear wall 47 of the duct 46 is beneath the top peripheral edge 32 of the tank, for directing the suctioned material against the cover 150, 168 over the tank, as described below.

An additional optional wet pick-up shoe 60 is illustrated in FIG. 7 as being plugged into the inlet channel 40. This plug in shoe also extends over the entire width of the channel 40. It includes its front and rear walls 61 and 62 which define the narrowed opening 64 at the bottom of the inlet channel. The narrowed front to back width of the opening 64 increases the rate of air flow, enabling suctioning of liquid. The pusher element 66 at the inside of the wet shoe pushes liquid to the opening 64 in the wet shoe 60. The wet shoe also has a front wall 68 which curves up to the underside of the below described front shoe 70 of the front wall 22 of the tank.

The front wall of the tank at its bottom and in front of the inlet channel 40 merges into the upwardly, forwardly curved shoe 70. The underside of the shoe 70 serves as a guide for the movement of the tank over a carpet and provides a smooth transition to the front wall 22 of the tank and the front of the inlet 41, so that the front of the tank does not dig into a carpet. The underside of the shoe 70 has a generally saw-toothed profile, as seen in FIG. 4. This includes the lower height sections 71 which alternate with the slightly upraised sections 73. The alternate upraised sections 73 provide an alternate pathway for entering air flow, so that there is a slight air flow to the inlet channel 40 from the front of the vacuum cleaner, which prevents the suction at the inlet from holding the vacuum cleaner to the floor or other surface being suctioned.

Figure 2:
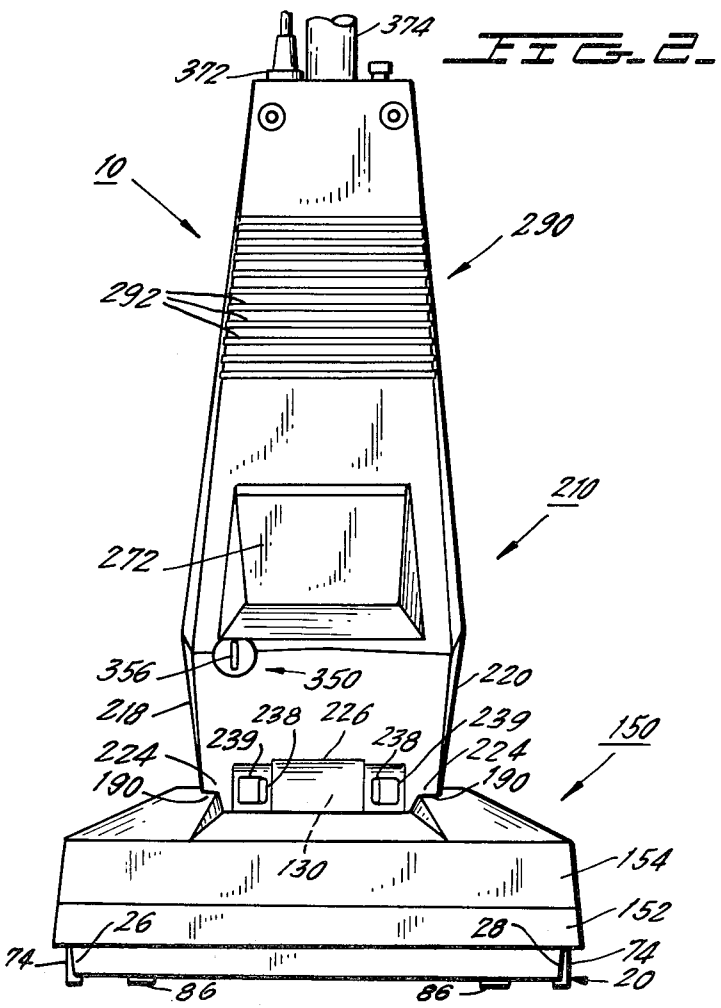
FIG. 2 is a front elevational view thereof.
Figure 1:
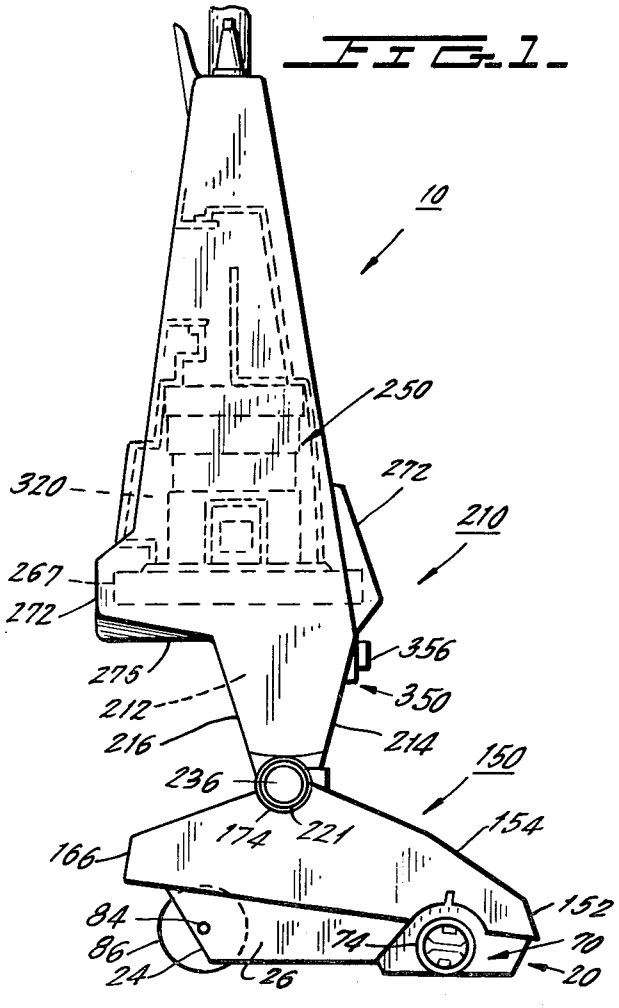
FIG. 1 is a side elevational view of a vacuum cleaner according to the invention.
Figure 3:
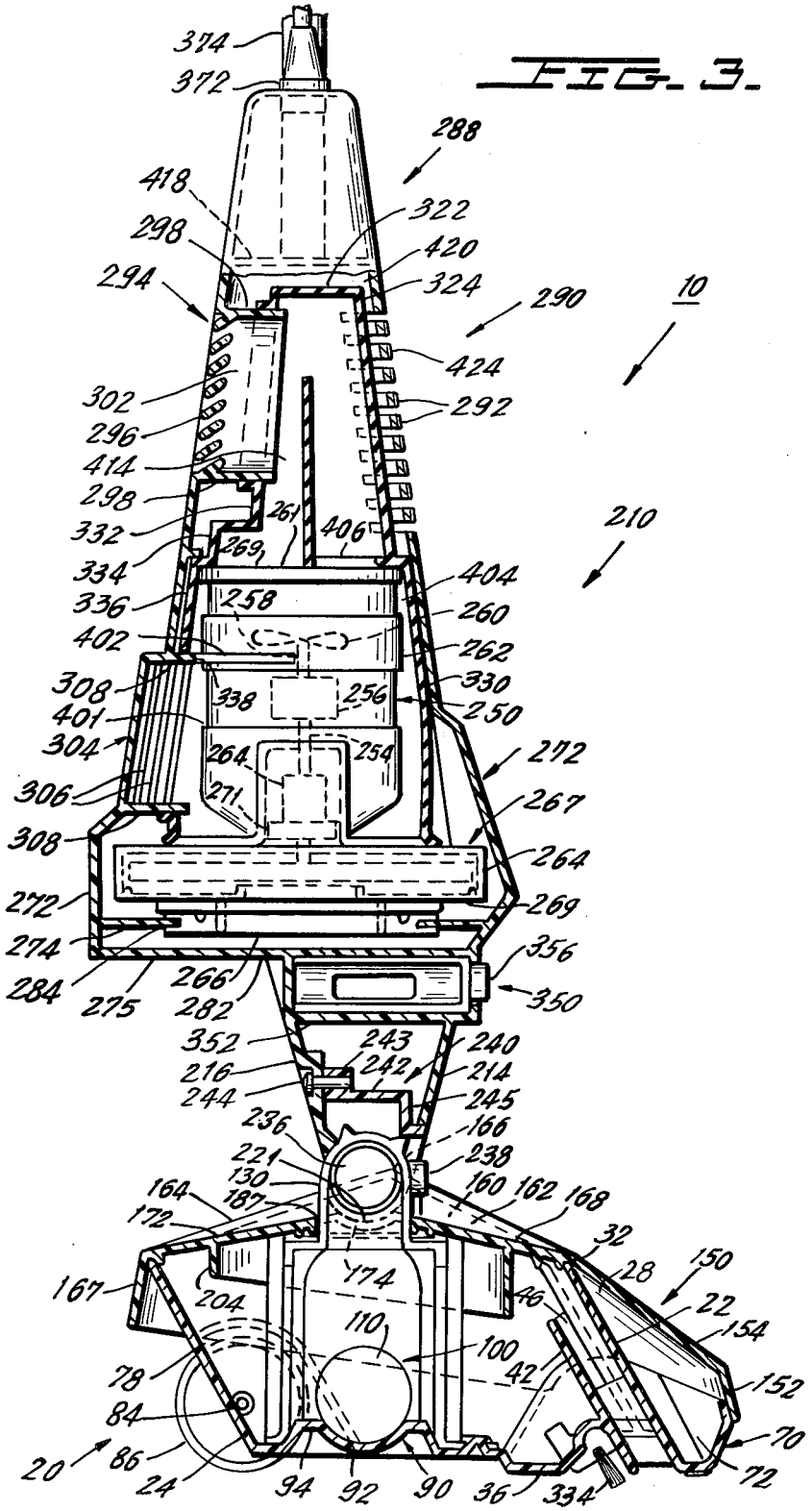
FIG. 3 is a side elevational view, partially cut away.

A pair of relatively tall, and long front-to-back, wells 72 shown in FIGS. 3, 4 and 7 are defined at the side walls 26, 28 of the tank. The wells are defined on their inwardly facing lateral sides by the respective indented sections 75 of the side walls of the tank. The wells 72 receive respective rollers 74, which enable the tank to be rolled over a carpet or other surface. These rollers are also part of the carpet height adjustment means, described below.

A pair of larger sized wells 78 are molded into the rear and bottom walls 24 and 34 of the tank. The sides of these wells have receptacles 82 for the axles 84 of the larger sized rollers 86 which support the rear side of the vacuum cleaner and which also enable the tank to be rolled over a surface.

Molded into the top side of the bottom 34 of the tank is the integral formation 90 for supporting the filter assembly, as shown in FIGS. 3, 4, 5, 7 and 13. The formation 90 includes the partially spherical depression 92, which is surrounded and defined by the taller flange 94. The exterior, downwardly inclined wall 96 is outside the flange 94.

The filter assembly 100 is comprised of a one-piece molded filter cage 102, which is comprised of an array of vertically disposed vanes 104 of generally T-shaped cross-section with the crossbar of the T facing outward. The cage 102 is essentially an open assembly. The inner edges 106 of the vanes 104 define the margins of a nest for a valve ball 110, which normally sits in the previously mentioned receptacle 92 at the bottom of the tank. The ball 110 normally sits in that receptacle during dry use of the vacuum cleaner. When water or liquid is being collected in the tank, the ball sits in the receptacle before the water floats the ball through the cage. As the tank fills with liquid, the ball 110 is floated up toward the top of the cage 102.

Toward the bottoms of the vanes 106, there is the bottom peripheral skirt 108 having a generally L-shaped cross-section. That skirt is staked at 112 to the bottom 34 of the tank.

The upper ends of the vanes 104 carry a continuous, annular, horizontal seat 116 that extends around the entire periphery of the cage. The seat 116 at the top of the vanes 104 comprises a plate having a collar 126 in it. There is a gasket 118 of resilient, yieldable material, such as rubber, or the like, which is seated upon and is also attached to the top of the seat 116. The gasket 118 cooperates with a depending rib 203 which passes around the entire gasket and extends down from the underside of the below described cover 150 over the tank for defining an air-tight seal within the filter cage against air that leaks into the tank past the below described T-fitting and past the gap between that T-fitting and the opening 187 in the tank cover through which the T-fitting passes.

On their interior edges and toward the seat 116, the vanes 104 curve inwardly, narrowing the chamber in which the ball 110 is contained and defining guides 124 for the ball 110 to rise against when the tank becomes filled with liquid. The guides 124 carry the annular collar 126 at their tops. When the ball 110 seats against the collar 126, this closes the passage past the collar 126 and shuts off suction from the blow motor to the suction inlet 40 when the tank is filled with liquid.

The collar 126 leads to the circular, vertical passageway 128. The passageway 128 opens into the underside of the horizontally disposed tube 130 at the opening 132. The passageway 128 and tube 130 together define a T-fitting. The horizontal tube 130 is open at both of its ends 134, 136, for providing suction communication between the below described blow motor and the tank. The tube 130 is supported above and spaced away from the seat 116 surrounding the annular collar 126. The tube 130 is supported by a series of upstanding ribs 138, which extend lengthwise of and beneath the tube 130.

The filter cage is surrounded by an annular sleeve or cuff shaped filter 140 of conventional fibrous filter material. The annular filter is slid over the cage and covers the spaces between the vanes 104. The length of the filter along the height of the filter cage is great enough that the filter can be pressed down on the flange 108 at the bottom of the filter cage. The filter also projects up far enough so that the cover 150 over the tank will press down on the top edge of the filter. The pressure against both the top and bottom edges of the filter securely closes the filter cage against leakage of air past the filter cage, other than through the filter.

There is a benefit in the filter cage 102 and filter 140 being secured in and thus being part of the tank 20. When dirt or liquid are to be emptied from the tank, the dirty filter travels together with the tank and the collected dirty material. If it is then desired to clean the entire tank, including the filter, the filter is at the same location where the dirt is emptied and the tank is being cleaned. This is an improvement over vacuum cleaners in which the filter is separated from the tank before the tank is emptied. In the latter situation, dirt may drop off the filter as it is removed before the tank is brought to be cleaned.

Adjustment of the height of the inlet opening 41 above the surface being suctioned, through carpet height adjustment means 300, accommodates various depth carpets, different surface textures being suctioned, suctioning of particulates or liquid, etc. There are various known techniques used for carpet height adjustment, including tilting the housing or changing the height of the inlet with respect to the housing. Another known technique which is adopted here, but using a unique mechanism, is to adjust the height of the front wheels 74 of the vacuum cleaner with respect to the bottom 34, 36 of the tank. Each wheel 74 is annular, having an internal surface 302 which rides on the external periphery of the guide track 304 defined around the bearing 301. The wheel 74 freely spins about its bearing 301. The bearing 301 includes the outward, radially outwardly projecting annular flange 306 which prevents the wheel 74 from falling outward off the bearing 301. The side wall 75 of the tank in the well 72 has the bearing 301 resting against it and blocks the wheel 74 from moving off the bearing in the other direction.

Figures 8, 9, 10, 11:
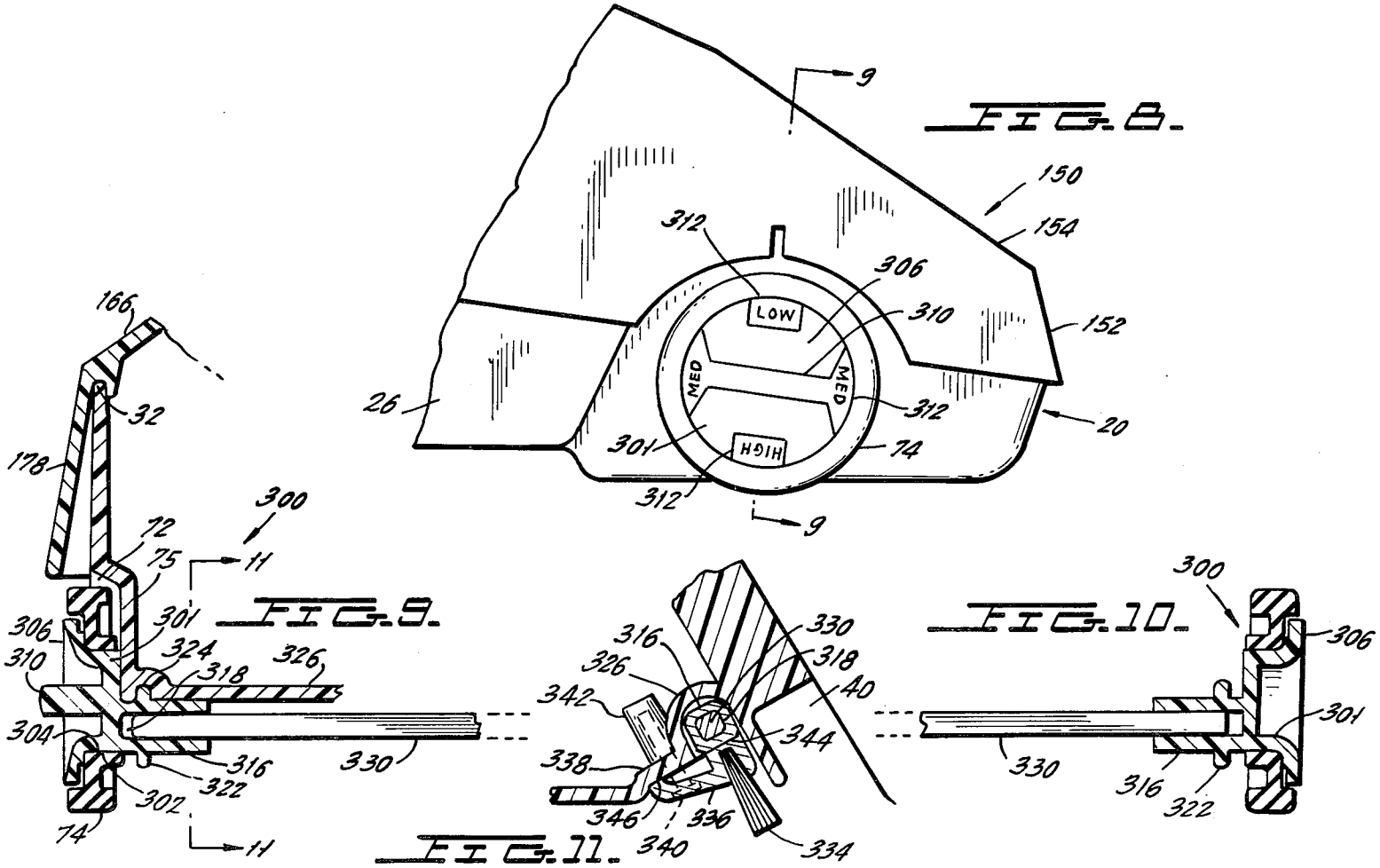
FIG. 8 is a side view of the front section of the tank showing height adjustment means.
FIGS. 9 and 10 are front views of the mounting and height adjustment at the front support of the tank.
FIG. 11 is a view along line 11—11 in FIG. 9 showing the area of the inlet to the tank.

At least one of the bearings 301 has the manually graspable knob 310 projecting laterally out from it and the knob 310 is turned to rotate the bearing 301 to a new orientation. When the bearing is not manually rotated, it maintains its then present orientation. The other bearing 301 at the other side of the vacuum cleaner is of the same construction as the first-mentioned bearing, except that it may not include the knob. As shown in FIG. 8, the surface of the flange 306 on the bearing carrying the knob 310 carries various indications of tank inlet height.

The indicator 312 that is rotated upright indicates whether the inlet to the vacuum cleaner will be elevated more or less above the surface being suctioned.

The inwardly facing side of each bearing 301 carries a respective short length, hollow sleeve 316. The sleeve opens to the inwardly facing side of the bearing and the opening 318 in the sleeve is of square cross-section, for reasons discussed below.

The front portion 36 of the underside of the tank at the well 72 has an upraised depression 326 formed in it which is shaped to receive the sleeve 316. The external corners of the sleeve 316 are rounded. The depression 326 positions the bearing sleeve 316 above the surface being suctioned.

Each sleeve 316 has an annular peripheral rib 322 extending around it. The bottom wall of the tank inside the depression 326 has a cooperating recess 324 molded into it, in which the rib 322 is received. The cooperation between the ribs 322 and the recesses 324 prevents the bearings 301 from moving laterally out from the vacuum cleaner tank, and thereby keeps the wheels 74 in place on the vacuum cleaner.

A rigid, metal shaft 330 of square cross-section extends across the underside of the tank of the vacuum cleaner beneath the well 72 and in the depression 326 and extends into both sleeve openings 318.

The sleeves 316 are eccentric with respect to the bearings 301. The positions of the sleeves with respect to the housing is fixed by the placement of the sleeves in the recessees 326.

The extent to which the center of the sleeves 316 is offset from the center of the bearings 301 determines the maximum height difference between the lowest and highest carpet height settings. To adjust the height of the inlet 41, the bearing 301 is rotated by the knob 310. This rotates the sleeves 316 and the shaft 330. Because of the eccentricity of the sleeves 316, the rotative position of the bearings 301 determines the height of the bottom wall 36 of the tank 20 with respect to the wheels 74 and thereby provides an inlet height adjustment.

There is a brush 334 which is disposed to the rear of the inlet channel 40 for brushing particulate materials or liquids to the inlet opening 41 for being suctioned in. The brush 334 is secured in the brush supporting plate 336 which, with the brush, extends the width of the vacuum cleaner. The brush supporting plate is secured to the underside of the tank at the section 338 by spaced apart bolts 340 which are received in respective recesses 342 which are molded in the underside of the tank. The brush plate 336 has a forward bearing surface 344 which normally is urged against the then facing flat surface of the sleeves 316. The rearward area of the plate 336 has a bearing surface 346 securely positioned against the section 338 of the tank through the bolts 340. Upon the sleeves 316 and the shaft 330 rotating, the rounded corners of the sleeves 316 press like cams upon the surface 344, and the plate 336 bends or flexes sufficiently to permit the sleeves 316 to rotate under resistance and permits the shaft 330 to rotate. This adjusts the height of the inlet.

Referring to FIGS. 3, 4, 7, 12 and 13, there is a cover 150 over the open top 32 of the tank 20, which completely encloses the tank, except for the opening 187 through the cover to permit the passage of the tube 130. Starting at the front of the vacuum cleaner and moving toward the rear, the cover 150 has a short height, upwardly, rearwardly, inclined wall 152, which covers over the top of the trough 70 at the very front of the vacuum cleaner. Above the short height wall 152, there is a more horizontal, inclined wall 154 which extends upwardly and rearwardly to the top 32 of the front wall 22 of the tank. The inclines of the walls 152 and 154 gives the front of the vacuum cleaner a better profile for being pushed under low furniture.

To the rear of the wall 154, the tank cover has a number of features across the tank cover from side to side. There are two taller chambers 160 at the opposite lateral sides of the tank cover. Each chamber 160 in the cover is defined by the upwardly rearwardly inclined front wall 162 and by the downwardly inclined rear wall 164 which walls meet at the apex 166. Rearwardly of the wall 164, at the top edge 32 of the tank, the cover turns down, defining the depending rear wall 167 of the cover. In the lateral space between the two chambers 160, the top of the tank has a front, upwardly, rearwardly inclined wall 168 which extends up from the top edge 32 of the front of the tank to approximately contact the exterior of the vertical tube 128, and it has a rear, downwardly, rearwardly inclined wall 172 that extends to the top edge 32 at the rear of the tank. The heights of the walls 168, 172, are selected so that they can cooperate with the bottom end of the motor housing 210, described below. Between the walls 168 and 172, there is a reduced height curved wall 174 which extends laterally beyond both sides of the tube 128 and which extends sideways out to the inwardly facing walls 186 of the chambers 160. The wall 174 is curvedly shaped to match the curved shape of the bottom of the motor housing which retains the spools 234 received by the horizontal tube 130 of the T-fitting. The rounded and depressed wall 174 is shaped to provide access to the ends 134, 136 of the tube 130 and to provide a support for the bottom of the motor housing and the spools thereof that cooperate with the tube 130.

From one lateral side of the tank cover to the other, the tank cover has a depending wall 178 which extends up to the upper edge 32 of the tank along the side of the tank. The wall 178 meets the inclined walls 162, 164 which are inclined upwardly from the front and rear upper edges 32 of the tank up to the apex 166 at which they meet and which are also inclined up from the wall 178. The inclined walls 162, 164 terminate at the flat top portion 184 of the tank cover which closes off the top of the chamber 160. The tank cover then dips down at vertical wall 186 past the correspondingly inclined side wall of the bottom portion of the motor housing and down to the above described curved wall 174 at the top of the cover.

Through the wall 174 of the tank cover, there is an opening 187 of a cross-section closely approximating that of the tube 130 of the T-fitting. That is the only opening through the tank cover. Moving across the tank cover to the other side of the tube 130, the tank cover is essentially a mirror image of what has already been described.

The walls defining the side chambers 160 of the tank cover each have a notch 190 which defines a wall 192 that is contacted by the front wall of the motor housing when the motor housing is swiveled forward around the pivot axis of the tube 130, as described below. This supplements the below-described detent mechanism for controlling pivoting of the motor housing.

To position the tank cover 150 over the tank, there is a peripheral rib 202 around the underside of the tank which is located to seat at the interior of the upper edge 32 of the tank, for both positioning the tank cover and sealing the tank at the tank cover. At the underside of the tank cover around the entire resilient gasket 118 around the opening 187, there is a depending rib 203 which presses into the gasket 118, thereby sealing the air pathway to the filter cage so that air only enters through the filter cage, as discussed above.

Also at the underside of the cover, there is a generally rectangularly profiled baffle 204, which extends down from the walls 168, 172 at the top of the tank cover part way to the bottom wall of the tank. The baffle is spaced out a short distance from the filter 110. The baffle 204 is longer toward its front side 205 and is shorter toward its rear side 206, with its connecting lateral sides 207 appropriately inclined. The baffle protects the filter 140 against spray which exits from the duct 46 toward the section 168 of the top wall of the tank cover. The length of the front wall 205 is great enough that it prevents spray from reaching the filter. The baffle also prevents liquid and materials that fall into the tank from splashing up and contacting the upper portion of the filter 110. Also, materials sprayed up against the cover wall 168 are directed to fall past the baffle wall 205. The rear wall 206 of the baffle need not be so long, since there is no similar spray problem at the rear of the filter.

The filter requires protection from the baffle 204 because the filter is of fibrous material. As liquid gathers in the tank 110 and contacts the filter by capillary action, it will migrate axially up along the filter, and the filter will always be wet a slight distance above the top of the liquid in the tank. If liquid were also being sprayed upon the top of the filter, it would migrate down along the filter under capillary action and under the influence of gravity. If the filter 110 becomes wet over its entire height, liquid will be suctioned off the filter and into the motor, in addition to air, and the blow motor will thereafter begin blowing water, which is undesirable. On the other hand, so long as at least part of the filter remains dry, the motor will be able to draw air through the filter and will not be suctioning water. The baffle 204 blocks water from the inlet duct 46 from splashing on the top part of the filter and blocks the splashing of liquid in the tank to the top of the filter, helping to prevent the upper portion of the filter from becoming wet and thereby maintaining the dry portion of the filter needed for the blow motor to suction air, rather than water.

As will become apparent below, the tube 130 of the T-fitting defines the entire pivot connection between the motor housing above and the tank and tank cover below. The filter cage on the bottom of the tank supports the horizontal tube 130, but the support provided by the base of the tank is too far away from the tube 130 to prevent the tube from rocking during use of the vacuum cleaner by moving the tank rearwardly and forwardly. The periphery around the opening 187 in the tank cover provides a supporting abutment for the front and rear sides of the vertical tube 128, thereby preventing rocking of the tube in the forward and rearward directions, which results from stresses occurring during use of the vacuum cleaner. Additionally, the rounded, depressed top wall 174 of the tank cover located beneath the motor housing receives the motor housing and prevents rocking of the tube 130 with respect to the tank and the tank cover.

The tank cover 150 is positioned over the tank but is not fastened to the tank. Instead, the motor housing and the spools 234 in the motor housing for cooperating with the tube 130, as described below, rest upon the rounded wall 174 at the top of the tank cover, cooperate with the tube 130 and hold the tank cover to the tank. Upon separation of the motor housing from the tube 130, described below, and removal of the motor housing, the tank cover can be simply lifted off the tank. The tank could then be emptied and cleaned.

With the entire vacuum cleaner assembled, when air, particulate materials and/or liquid are suctioned through the inlet channel 40 and through the duct 46, they are blown against the section 168 of the top wall of the tank. The material then falls toward the bottom of the tank because it suddenly enters the enlarged plenum defined inside the tank, which reduces intake air velocity. The baffle 204 helps direct materials to fall.

Above the tank and tank cover there is the motor housing 210 for a blow motor and the operator's handle 374 for moving the vacuum cleaner. The motor housing has a lower plenum chamber 212. The lower plenum chamber is enclosed between the inclined front wall 214, inclined opposite rear wall 216 and inclined opposite side walls 218, 220. These walls are inclined for aesthetic purposes. The walls 214, 216 converge toward the bottom of the motor housing giving the bottom portion a generally triangular appearance, and they meet at the rounded bottom wall 221 of the motor housing, which is convexly rounded corresponding to the concavely rounded depressed upper wall 174 of the tank cover. The cooperating rounded surfaces permit the pivoting of the motor housing around the axis of the tube 130. The front wall 214 is also inclined to cooperate with the above described wall 192 of the notch 190 defining the maximum forward pivoting of the motor housing, through the contact between the walls 214 and 192. Toward the bottom of the motor housing plenum chamber 212 along the side walls 218, 220, narrow width suction chambers 222, 224 are defined, and these open upwardly directly into the enlarged plenum chamber 212 within the lower part of the motor housing.

The bottom of the motor housing 210 has a number of sections between its lateral sides. The central section 226 is a flat wall across the plenum chamber 212 extending from the front wall 214 to the rear wall 216. The wall 226 closes off the bottom of the motor housing between the opposite ends 134, 136 of the tube 130. Beyond each end of the tube 30, and toward the small volume chambers 222, 224, the bottom wall of the housing becomes an annular sleeve 228, having an open end at 230 which simply opens into the chamber 222. The sleeves 228 have minimal clearance above the top of the tube 130 and they simply move around the tube 130 as the motor housing pivots around the axis of the tube 130. Beyond the sleeve 228, 230, the motor housing bottom wall 221 defines the bottoms of the chambers 222, 224.

Supported air-tightly within each sleeve 228 is an axially shiftable, hollow spool 234. Each spool is shiftable from a position where its inlet end is out of the tube 130 to a position where its inlet end 236 is within the tube 130. When the inlet ends 236 are within the tube 130, the spools 234 inside the tubes 130 lock the spools and tube together. This locks the tube 130 to the motor housing and thereby assembles the tank, tank cover and motor housing together as a single unit. Furthermore, the hollow spools 234 complete the air pathway into the motor housing plenum 212 from the air inlet through the tank, through the tubes 128 and 130, through the spools 234 and the chambers 222, 224 into the plenum 212. Projecting from the forwardly facing, lateral side of each spool 234 is a hand operable lever 238, which projects forwardly out of the respective sleeve 228 through the window 239 in the sleeve. The lateral side edges 241 defining the window 239 define the terminal positions of axial shifting of the handles 238 and of the respective spools, which are then selectively inside and locked to the tube 130 or outside the tube 130 for permitting the motor housing to be separated from the tube 130. The spools 234 thus serve to lock the sleeves 228 and thereby the motor housing to the tube 130 while permiting the motor housing to swivel around the axis of the tube 130 with respect to the tube 130. The spools cause the sleeves 228 to press down upon the cover of the tank and prevent air and dirt leakage out of the tank past the cover.

Control over the tilt position of the motor housing 210 with respect to the tank and tank cover is obtained through the cooperating detent arrangement 240 shown in FIG. 7. The detent arrangement 240 comprises a resilient plastic material spring 242 having a base 243 which is rigidly supported by the bolt 244 to the rear wall 216 of the motor housing. The spring 242 includes its forwardly extending support arm, which includes the depending portion 245. The portion 245 has two surfaces of significance. The rearwardly facing resist or detent surface 246 resists the rearward pivoting of the motor housing 210, and the downwardly facing return surface 247 permits the return forward pivoting of the motor housing, without significant resistance. In addition, the rear wall 216 of the housing 210 has a short, forwardly projecting flap 251 beneath bolt 244 and positioned to be abutted by below-described projection 249.

The top surface of the tube 130, which defines the outlet from the tank, has two triangular profile, circumferentally separated, detent projections 248, 249 which cooperate with the surfaces 246 and 247 on the portion 245 and with flap 251. When the motor housing 210 is pivoted forwardly, the downwardly facing surface 247 simply rides over the rearwardly facing cooperating surfaces of the projections 249 and 248, without significant resistance, and this override simply flexes the resilient spring 242 upwardly so that the portion 245 will clear these projections. Eventually, the forwardly tilting flap 251 abuts the rearward surface of the projection 249 and the rigid flap cannot pass this projection, whereby this establishes the forward terminal pivot position for the motor housing 210. Other alternative abutment arrangements can be envisioned.

Moving the motor housing 210 rearwardly from its forward terminal position, the hook-like portion surface 246 meets the cooperating forwardly facing surface of the projection 248. These cooperating surfaces are oriented so that the spring 242 will resist the further rearward movement of the motor housing. However, exertion of sufficientminimal force overrides this small resistance. The projections 248 and 251 establish the storage position of the motor housing 210. The storage position of the motor housing places its center of gravity so that the motor housing will be stable upstanding. The resistance to rearward tilting of the motor housing 210 may be low enough that the hook-like portion 245 will not raise the front of the vacuum cleaner off the surface when the motor housing 210 is tilted rearwardly. It is also possible to design the resistance of the cooperating hook-like portion 245 and projection 248 that a user will actually have to place weight on the tank, such as the user's foot, to prevent the tank from being lifted as the motor housing is tilted rearwardly.

Once the hook-like portion 245 is between the projections 249 and 248, the motor housing is in the normal operational position and the forward and backward movement of the vacuum cleaner by the user will cause the motor housing to pivot over an arc where the hook-like portion 245 is between the projections 248 and 249. When the motor housing 210 is tilted far enough rearwardly, the surface 246 of the hook-like portion 245 contacts the forwardly facing surface of the projection 249, which normally prevents further rearward tilting of the motor housing while the tank remains on the floor. When the motor housing is tilted further rearward, the cooperation between the hook-like portion 245 and the rear projection 249 tilts the front of the vacuum cleaner and tank upwardly, as might be required when an obstacle is to be cleared. However, if it is desired to lay the motor housing 210 down straight backward while the tank rests flat on the floor, it is necessary to override the projection 249. To this end, the user will have to manually restrain the lifting of the tank, e.g. by placing his foot on the tank as the motor housing is tilted back, and then the hook-like portion 245 will clear the rearward projection 249. In this way, the various tilt positions of the motor housing and the handle are detent controlled.

Referring to FIGS. 3 and 4, the motor 250 is mounted and supported in the motor housing 210 and the motor housing is shaped to receive and support the motor and to provide air inlet and outlet vents for the motor.

One motor 250 contemplated for use in connection with the present invention is a conventional by-pass type blow motor, which has been modified to direct the airflow from the blow motor through the motor housing. The blow motor 250 includes a centrifugal fan 252 which is driven through shaft 254 by drive motor 256. The drive motor also drives the blow motor cooling fan 260 through the shaft 258. The blow motor is housed in its own casing or enclosure 262, and this enclosure has an open top 261 to permit entrance of cooling air into the enclosure for cooling the motor. Visible at one lateral side of the motor is one of the motor brush contacts 263.

Referring to FIGS. 3, 4, 14 and 15, the centrifugal fan 252 is housed in its own short length, wide diameter enclosure 264. Inlet to the centrifugal fan is through the opening 266 at the bottom plate 269 of the enclosure 264. Normally, exit from the enclosure 264 would be peripherally, because it encloses a centrifugal fan. However, the enclosure 264 has been modified to block outlet of air around the periphery of the enclosure 264. Instead, the top plate 267 of the enclosure 264 has been provided with two annular rows of outlet holes 268. The centrifugal fan 252 sucks air through the inlet 266 and blows it out of the enclosure 264 through the outlet openings 268, so that the air will then blow upwardly through the motor housing.

The bottom plate 269 of the blow motor 250 has been configured to seat in the motor housing 210 and the motor housing 210 has been internally configured to receive the bottom of the blow motor. Inside the motor housing 210, above the lower chamber 212 thereof, there is the sharply widened chamber 272 in which the fan enclosure 264 at the bottom of the motor housing is located.

A horizontal supporting wall 274 is integrally formed in the motor housing chamber 272 just above the inlet section 212. The plate 274 extends around the entire motor housing. The plate has an approximately square opening 276 defined in it for guiding and fixedly positioning the blow motor in the motor housing. The inlet 266 to the centrifugal fan enclosure 264 is defined by the circular opening 278 in the plate 269 at the bottom of the enclosure 264. An approximately square shaped depending collar, with rounded corners 280, is attached at the underside of bottom plate 269 of the motor housing and is spaced out from the circular opening 278. The collar 280 defines an internal marginal support for a resilient gasket 282.

The gasket 282 is an annular, rectangular flat element comprised of stiff, but resilient material. At its interior margin, it surrounds and securely engages the exterior of the collar 280. The exterior peripheral section 284 of the gasket 282 wraps around the edge of the opening 276 in the plate 274. The gasket is molded in shape so that it wraps around the collar 280 and seals on the plate 274. The gasket, therefore, forms an air seal between the vacuum cleaner inlet 40 and the lower chamber 212 of the motor housing, on the one hand, and the outlets from the blow motor fan 252. The square shapes of the opening 276 in the plate 274 and of the collar 280 and the corresponding shape of the gasket 282 is to help fix the motor 250 against spinning in the housing, especially during start-up rotation of the motor. Also, the resilient gasket 282 serves as a vibration damper for the motor. This has the effect of reducing the noise generated by the vacuum cleaner.

The top 261 of the motor casing has the motor cooling air inlet 269. A cooling air outlet is formed in the motor casing at 271 beneath the electric motor and above the centrifugal fan enclosure upper plate 267.

If the blow motor suctions any liquid, it will drop on to the plate 274. Therefore, a small open drain (not shown) passes through the plate 274 to the exterior of the motor housing for enabling the draining of the liquid. The lower portion 212 of the motor housing is shaped to widen so that the suction pull on the water will reduce toward the top of the lower portion of the motor housing and the water will fall back away from the fan and into the tank. But the water flow problem must still be dealt with.

The conventional blow motor has two air paths which must remain separate, the air path from the inlet 266 through the outlet 268 of the main, centrifugal fan 252 and the cooling air path through from the inlet 269 through the outlet 271. To separate the two air flows, to lead them to their respective vents from the motor housing and to elongate the path of the air flow from the main outlet 271, a unique cuff and baffle arrangement 320 is placed around the motor and extends up from it.

For passage of air into and out of the motor casing for the two separate flows of air, a number of ducts are provided in the motor housing 210. For the air exiting from the outlet openings 268 on the upper plate 267 of the centrifugal fan, an outlet duct 290 is defined near the top of and extends completely across the width of the front wall of the housing 210. The outlet duct 290 is covered over by horizontal louvres 292 to prevent finger access into the housing. A quite long pathway is defined between the outlet openings 268 from the fan and the outlet duct 290 from the motor housing, so that the air exiting from the centrifugal fan will travel through the housing and the noise and vibration of that air will tend to be damped.

On the rear wall of the upper portion 288 of the motor housing 210, slightly above the cooling air flow inlet 269 to the motor housing, a motor cooling air inlet duct 294 is provided. It is closed by downwardly inclined louvres 296, which prevent finger access into the housing. On the interior of the motor housing, the cooling air inlet duct 294 is defined by top and bottom inwardly projecting plates 298 and lateral side inwardly projecting plates 302 which together define a generally rectangular shape for the inlet duct. This cooperates with a corresponding opening in the below described cuff 320.

Figure 17:
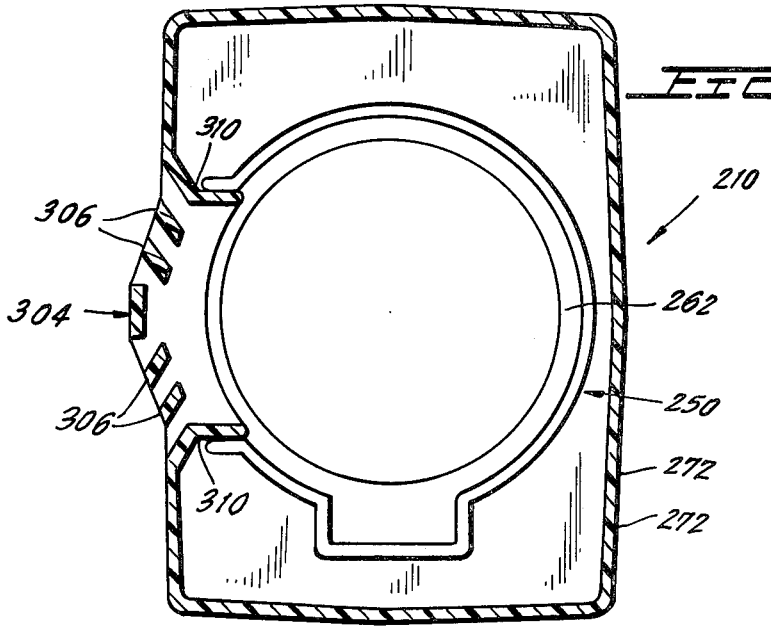
FIG. 17 is a cross-sectional view through the motor housing at line 17 in FIG. 14.
Figure 14:
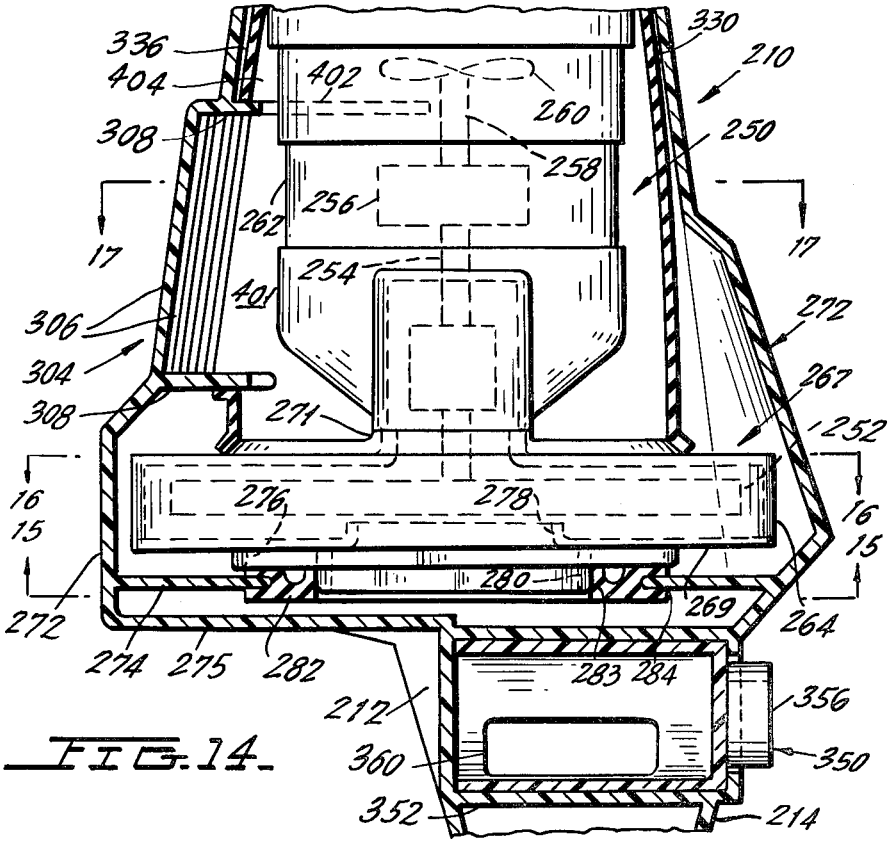
FIG. 14 is an enlarged fragmentary view of the region of the motor housing at the blow motor.
Figure 15:
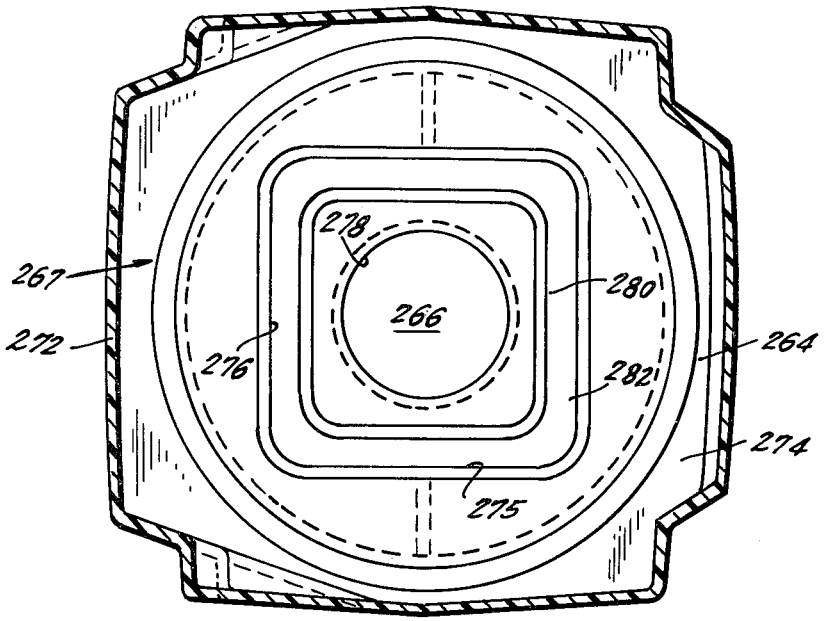
FIG. 15 is a bottom view of the blow motor mounted in the vacuum cleaner.
Figure 16:
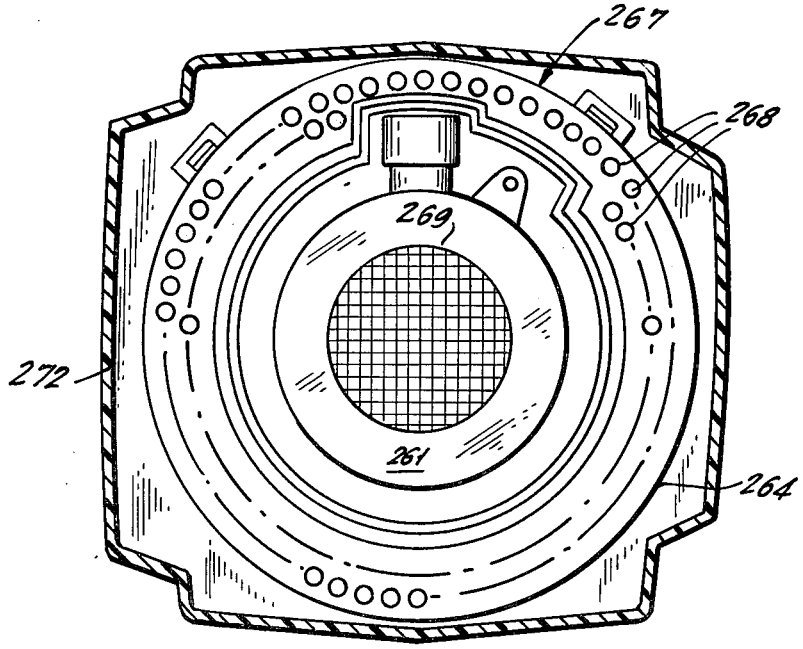
FIG. 16 is a top view of the blow motor in the vacuum cleaner.

At the rear side of the vacuum cleaner, toward the bottom of the upper portion 288 of the motor housing and near to the plate 267 and to the outlet 271 for the motor cooling air, a cooling air outlet duct 304 is defined. It is protected by finger access preventing vertically oriented louvres 306. In addition, as can be seen in FIG. 17, the louvres 306 are aimed to direct the air generally laterally of the vacuum cleaner, rather than straight out the rear. Not only does this prevent the air from being blown against the operator, but when the motor housing 210 is tilted far rearwardly, the air is directed by the louvres 306 so that it will not blow against the surface being cleaned, avoiding possible stirring of dirt on the surface. On the interior of the motor housing, the outlet duct 304 is defined by top and bottom walls 308 and by cooperating lateral walls 310 which define a rectangular shape for the duct 304 in the motor housing. The walls around the duct extend through an opening in the below-described cuff 320 and the cuff is supported around these walls. Furthermore, the top and bottom walls 308 support the louvres 306.

The cuff 320 is shaped for providing air seals around the motor casing and for including openings to permit the two separate air flows through the motor casing for serving the blow motor. The cuff is a molded unit of a soft, resilient material such as rubber, and the cuff is shaped for making the required seals within the motor housing. Additionally, because the cuff is soft and resilient, it tends to absorb vibration and damps noise and vibration in the air passing by the cuff, making vacuum cleaner operation quieter.

With reference to FIGS. 3 and 4, the cuff 320 is now described. Starting at the top of the cuff, it has an upper end 322 which extends forwardly and rearwardly in the vacuum cleaner. It has a front section 324 passing down the inside of and closing off the interior of the cuff from the main front outlet opening 290 in the motor housing 210. The upper section 324 of the cuff is narrower than the width of the main outlet opening 290 and the outlet opening 290 is on the outside of the cuff 324, and the cuff separates the air flow path to the outlet 290 from the space inside the cuff 320. The cuff seals against the periphery of the top 261 of the motor casing 250. The cuff has a lower front section 330 which extends down to and seals upon the top plate 267 of the centrifugal fan casing 264. The cuff wraps around the side of the motor casing toward the rear thereof. Starting again at the top of the cuff 322, it has a rear upper portion 332 which extends past the cooling air inflow duct 294. The cuff has an opening at the walls defining the duct 294 and those walls pass through the opening in the cuff. Below this duct, the cuff has a section 334 which seals against the top 269 of the motor casing. The cuff has a lower section 336 which extends past the cooling air outlet duct 304. The cuff section 336 has an opening at the duct 304 for the walls defining the duct 304 to pass through the cut and seal there. The cuff 320 at the rear side also seals against the top plate 267 of the centrifugal fan casing 264. The cuff confines air entering through the cooling air inlet 294 inside the cuff and directs the air to the cooling air inlet 269. Similarly, the cuff confines the air exiting from the outlet 271 to move through the outlet 304, and prevents its escape elsewhere.

Therefore, the cuff 320 separates the cooling air entering the motor housing 210 through the inlet 294 and entering the motor casing through the inlet 269 from that air exiting from the motor casing at the exit 271 and from the motor housing through the outlet 304, and also separates the cooling air outlet flow from the main fan oultets 268 which is instead directed outside the cuff 320.

Next, the main air flow pathway from the outlets 268 in the top plate 267 of the centrifual fan is reviewed.

Air exiting from the outlet openings 268 passes upwardly through the housing 210 around the entire exterior of the cuff 320, passing by the walls around outlet duct 304 until the air flow intercepts the horizontal baffle plate 402 which is molded inside the rear half of the housing 210, and which completely surrounds the exterior of the cuff 320 between the lateral sides of the motor housing and extends approximately halfway to the front of the casing. A first chamber 401 is defined between the top late 267 and the baffle plate 402. The air is now blocked from traveling up around the rear half of the cuff 320 by the baffle plate 402 and all of the air is now directed forwardly to pass through the front half of the motor housing 210 around the outside of the cuff 320 and forward of the front edge of the baffle plate 402. The air is now directed into a second chamber 404, above the first chamber 401 and more toward the front of the housing. Above the chamber 404 is another horizontal baffle 406 which is also outside the periphery of the cuff 320, which wraps around the front of the cuff and extends about halfway back to the rear of the housing 210. Extending up from the horizontal baffle 406 and at the two lateral sides of the cuff 320 are the upstanding lateral baffle walls 410, 412. These walls extend up from the horizontal baffle 406 and define a third chamber 414 outside of the cuff 320 and behind the baffle walls 410, 412 up through which the air travels. The air travels to the top wall 418, which then redirects the air forwardly through the open passageway 420 between the top wall and the top of the upstanding walls 410, 412. Since the wall 418 descends sharply toward the top of the cuff at the center portion 422 of the wall 418, the passageway 420 is actually two lateral side passageways. Air passing through the passageways 420 enters a fourth chamber 424 toward the top, front of the vacuum cleaner and this chamber communicates with the main air flow outlet 290. The front opening 290 is louvred and extends across the entire width of the front of the housing, as noted above, so as to provide a large area exit for the air, reducing the velocity of the air as it exits through the outlet duct 290. The air flows through a plurality of chambers 401, 404, 414 and 424. Each of these chambers causes a redirection of the flow of air, slows the velocity of the air and also absorbs vibration, for reducing noise and velocity of the air eventually exiting through the outlet duct 290.

A suction force control mechanism 350 is provided for controlling the suction force at the inlet channel 40 of the tank. It functions to recirculate air from the outlets 268 of the centrifugal fan back to the inlet 266 thereof. The motor housing 210 includes a cylinder support 352 which supports the rotatable cylinder 354, whose rotation is controlled by the knob 356 projecting from the front of the vacuum cleaner. The cylinder support 352 has an angular segment opening 356 through it which communicates into the motor housing beneath the inlet 266 to the centrifugal fan. The rotatable cylinder 354 inside the cylinder support 352 has two spaced apart, angular segment openings 358, 360 through it. There is an opening 362 through the plate 274 which is also outside the gasket 282 and which therefore communicates with the air that has exited from the outlets 268 from the centrifugal fan. There can be air flow communication from the fan outlets 268 through the plate 274 and the opening 362, through the cylinder opening 358, across the cylinder 354, through the cylinder opening 360 and the cylinder support opening 356 and into the lower section of the housing 210. By the knob 356, the cylinder 354 can be rotated to various positions, between the position cutting off communication between the passageway 362 and the cylinder opening 358, through positions permitting gradually greater air flow communication between the passageway 362 and the housing section 310 through the openings 358, 360, 356 and to a maximum air flow position. The extent to which this passageway is enlarged determines the proportion of the air which exits from the fan outlets 268 that is recirculated to the fan inlet 266, and thereby controls the suction at the inlet channel 40. Since the vacuum cleaner is used for suctioning particulate materials of various weights and consistencies and/or for suctioning liquids, and because wet materials, and liquid especially, require greater suction, this suction force adjustment is valuable.

There is a benefit to the internal air recirculation illustrated here. First, air which has already been filtered is being recirculated, which avoids contamination problems. Although it would be possible to divert air externally of the housing, rather than recirculating it, this would require an external orifice which could become blocked or through which material could enter. Also, an external opening in the housing at this location would generate noise. The internal recirculation suction force control mechanism just described avoids these problems.

At the top of the motor housing, a power cord 370 enters the motor housing through a conventional strain relief fitting 372 and is conventionally connected to the motor housing. A conventional manually graspable handle 374 is secured in the motor housing by securement means designed to secure the handle to the motor housing without undue stress on either the handle or the motor housing.

There has just been described an electric vacuum cleaner with a number of beneficial features including a collecting tank which can be simply separated from the rest of the vacuum cleaner for subsequent cleaning, where the dirty filter remains with the tank of the vacuum cleaner, which is able to utilize a by-pass type motor in a motor housing separate from the collecting tank where the tank and the cover over the tank can be readily separated from and reattached to the motor housing, where the blow motor is well supported in the motor housing, where the main and cooling air flows of the blow motor are properly separated, where noise and vibration of the motor are damped and where air flow regulation is readily accomplished by recirculating air.

Although the present invention has been described in connection with a preferred embodiment thereof, many variations and modifications will now become apparent to those skilled in the art. It is preferred, therefore, that the scope of the invention be limited not by the specific disclosure herein, but only by the appended claims.

What is claimed is:

1. An electric vacuum cleaner, comprising:

a suction motor for moving air past itself;

a motor housing for containing the motor; the housing having a bottom, a top, an air inlet at the bottom, and an air outlet;

a collecting tank for collecting materials drawn into the tank; the collecting tank having a bottom; an inlet into the bottom of the tank for entrance of air and collected materials to be sucked into and collected in the tank; the tank having a top; a cover over the tank top;

first connecting means extending up from the tank cover; second connecting means at the bottom of the motor housing; the first and second connecting means being connected together for joining the tank and the motor housing;

the first and second connecting means being shaped for permitting the housing to swing back and forth over and with respect to the tank; the first and second connecting means also including an airflow pathway therethrough which is the sole pathway for air to flow from the tank to the suction motor in the motor housing.

2. The electric vacuum cleaner of claim 1, wherein the bottom of the motor housing is rounded around a swing axis about which the housing swings with respect to the tank; the tank cover including a depression formed therein and shaped generally to the shape of the rounded bottom of the housing; the first and second connecting means supporting the housing bottom in the depression in the tank cover for enabling the housing to swing with respect to the tank cover around the housing swing axis.

3. The electric vacuum cleaner of claim 2, wherein the tank cover is separable from the tank; the bottom of the housing and the first and second connecting means all being shaped and adapted for holding the cover over the tank for also enclosing the tank to block air leakage past the tank cover.

4. The electric vacuum cleaner of claim 2, wherein the first connecting means comprises a tube projecting above the tank cover and extending along the swing axis of the housing, the tube having a first length between its opposite ends; the bottom of the motor housing being wider than the first length of the tube; the bottom of the motor housing being shaped to conform to the shape of the tube projecting above the tank cover for the tube to be received in the conformed shape of the bottom of the housing;

the second connecting means comprising the bottom of the motor housing including a respective side section thereof at both ends of the tube; each side section extending down into the tank cover depression and extending down past the ends of the tube, and the tube communicating into each of the side sections at the bottom of the motor housing.

5. The electric vacuum cleaner of claim 4, wherein the housing side sections are in air flow communication with the ends of the tube, and the tube is in air flow communication with the tank for providing an air pathway from the tank, through the tube, into the side sections of the motor housing, whereby the side sections of the motor housing serve as an air inlet to the motor housing; the side sections being in air flow communication with the motor.

6. The electric vacuum cleaner of claim 5, wherein the first and second connection means further comprise mechanical connection means at the side sections at the bottom of the motor housing and also at the tube for separably mechanically connecting the side sections of the motor housing to the tube and for permitting the housing to swing with respect to the tank cover when the side sections and the tube are mechanically connected.

7. The electric vacuum cleaner of claim 6, wherein the mechanical connection means comprise a spool in at least one of the side sections of the housing and shaped to fit to the respective end of the tube at that one side section; the spool being shiftable to selectively connect with the tube for securing the tube to the one side section and to free the tube and the one side section to be separated.

8. The electric vacuum cleaner of claim 7, wherein the spool is hollow and is in air flow communication with the tube, when the spool is connected with the tube for securing the tube and the one side section together, and the spool thereby defining part of the air flow pathway from the tank through the tube to the one side section of the motor housing.

9. The electric vacuum cleaner of claim 6, further comprising a support for the tube, and the tube support being secured in the tank for supporting the tube above the tank cover.

10. The electric vacuum cleaner of claim 9, wherein the tank cover has an opening therethrough, through which the tube support projects.

11. The electric vacuum cleaner of claim 10, wherein the tube support comprises a cage adapted for permitting air flow through itself and being shaped for receiving and supporting a particulate material filtering element thereon, the tube support cage having an outlet therefrom which also defines the inlet to the tube, whereby a filter placed over the cage filters air flowing from the tank into the tube and into the motor housing.

12. The electric vacuum cleaner of claim 11, further comprising a filter on the filter cage and the filter being shaped so that air flow from the tank into the tube inlet is past the filter and through the filter cage.

13. An electric vacuum cleaner, comprising:

a suction motor for moving air past itself;

a motor housing for containing the motor; the housing having a bottom, a top, an air inlet at the bottom, and an air outlet;

a collecting tank for collecting materials drawn into the tank; the collecting tank having a bottom; an inlet into the bottom of the tank for entrance of air and collected materials to be sucked into and collected in the tank; the tank having a top; a cover over the tank top;

first connecting means extending up from the tank cover; second connecting means at the bottom of the motor housing; the first and second connecting means being connected together for joining the tank and the motor housing; the first and second connecting means also including and defining an air flow pathway therethrough for air to flow from the tank into the motor housing;

the suction motor being a bypass type motor, including a fan driving motor, a main suction fan connected with the driving motor for being driven to move air through the main suction fan, a secondary cooling fan also connected with the driving motor for being driven to move air past the cooling fan and the cooling fan being placed and operable for blowing cooling air over the driving motor, and a casing over the suction motor;

the casing having a main fan inlet at the inlet side of the main suction fan, a main fan outlet for passing therethrough air blown by and past the main suction fan, a secondary fan inlet at one side of the driving motor and a secondary fan outlet at the opposite side of the driving motor; and the secondary cooling fan being oriented and operable for moving air into the casing through the secondary fan inlet, over the driving motor, and out of the casing through the secondary fan outlet;

mounting means mounting and supporting the suction motor in the motor housing; the suction motor being oriented so that the main fan inlet communicates into the bottom of the motor housing for receiving air entering the motor housing from the tank;

the motor housing having a main housing outlet therethrough for passing air from the main fan outlet, a secondary housing inlet for inlet of air to the secondary fan inlet, and a secondary housing outlet for outlet of air from the secondary fan outlet;

cuff means of resilient material located in the housing and passing over the bypass type suction motor, the cuff means being shaped and positioned for contacting the motor casing and for separating from each other the air flow through the main fan outlet, the secondary fan inlet and the secondary fan outlet; the cuff also being shaped and positioned for connecting the main fan outlet with the main housing outlet, the secondary fan inlet with the secondary housing inlet and the secondary fan outlet with the secondary housing outlet; the mounting means for the suction motor also being shaped for separating the main fan inlet from the main fan outlet and for separating the main fan inlet from the secondary fan inlet and from the secondary fan outlet.

14. The electric vacuum cleaner of claim 13, wherein the motor housing is defined by an exterior wall surrounding the suction motor and the cuff;

the main fan outlet communicates with the main housing outlet through a first space defined between the cuff and the wall of the motor housing, the secondary fan inlet communicates with the secondary housing inlet through a second space defined inside the cuff and the secondary fan outlet communicates with the secondary housing outlet through a third space defined inside the cuff; the cuff and the motor casing separating the first, second and third spaces from one another.

15. The electric vacuum cleaner of claim 14, wherein the main fan inlet faces toward the bottoms of the motor casing and the motor housing, the main fan outlet opens out generally from the side of the motor casing above the main fan inlet; the secondary fan inlet faces generally toward the tops of the motor casing and the motor housing, and the secondary fan outlet faces out of the side of the motor casing below the secondary fan inlet and above the main fan outlet.

16. The electric vacuum cleaner of claim 15, wherein the casing of the suction motor is wider at the main suction fan than it is above the main suction fan, and the main fan outlet is thereby at a location outward beyond the secondary fan outlet from the casing.

17. The electric vacuum cleaner of claim 16, wherein the cuff is supported by the motor casing spaced inwardly from the interior of the motor housing, while the cuff meets and seals at the motor housing, at the secondary outlet and at the secondary inlet.

18. The electric vacuum cleaner of claim 17, wherein the first space comprises:

a first horizontal baffle in the housing extending around the cuff and from the rear of the housing partway toward the front of the housing and spaced up from the main fan outlet for defining a first chamber between the main fan outlet and the first baffle;

a second horizontal baffle in the housing, extending around the cuff from the front of the housing partway toward the rear of the housing and spaced up from the first baffle for defining a second chamber between the first and second baffles;

third baffle walls in the housing upstanding from the second baffle, next to the cuff for defining a third chamber above the second baffle and behind the third baffle walls;

a fourth chamber in front of the third baffle walls and the fourth chamber communicating over the third baffle walls with the fourth chamber; and the fourth chamber communicating with the main outlet from the motor housing.

19. The electric vacuum cleaner of claim 1, further comprising:

the tank inlet comprising a narrow slot-like opening extending across the width of the tank toward the lateral side walls of the tank; the inlet opening to the tank merging into a narrower width passageway, narrower in lateral width than the width of the inlet slot, and defined on the tank, and the passageway communicating into the tank generally at the lateral center of the tank toward the front of the tank; the passageway being shaped to extend from the bottom of the tank up toward the top of the tank, whereby the air and materials exiting from the passageway exit at the top of the tank and being placed to have material exit the tank outlet is generally centrally located between the lateral side walls of the tank and is located rearwardly of the exit from the passageway;

a filter extending vertically in the tank for filtering air passing from the tank into the inlet of the motor housing; and a baffle extending down from the tank cover partially down past the filter and positioned for redirecting collected material exiting from the passageway downwardly past the baffle for keeping it away from the filter.

20. An electric vacuum cleaner, comprising:

a suction motor for moving air past itself;

a motor housing for containing the motor; the housing having a bottom, a top, an air inlet at the bottom, and an air outlet;

a collecting tank for collecting materials drawn into the tank; the collecting tank having a bottom; an inlet into the bottom of the tank for entrance of air and collected materials to be sucked into and collected in the tank; the tank having a top; a cover over the tank top;

first connecting means extending up from the tank cover; second connecting means at the bottom of the motor housing; the first and second connecting means being connected together for joining the tank and the motor housing; the first and second connecting means also including and defining an air flow pathway therethrough for air to flow from the tank into the motor housing;

the suction motor including a fan driving motor, a suction fan connected with the driving motor for being driven to move air through the suction fan, and a casing over the suction motor; the casing having a main fan inlet at the inlet side of the main suction fan and a main fan outlet for passing therethrough air blown by and past the main suction fan;

mounting means mounting and supporting the suction motor casing in the motor housing; the suction motor being oriented so that the main fan inlet communicates into the bottom of the motor housing for receiving air entering the motor housing from the tank; the mounting means separating the airflow between the main fan inlet and the main fan outlet; the motor housing having a main housing outlet therethrough for passing air from the main fan outlet;

a suction force control mechanism in the motor housing comprising communication means communicating with the main fan outlet and communicating, past the mounting means for the motor casing in the motor housing, to the area in the housing communicating with the main fan inlet;

a flow regulator for adjusting the rate of air flow through the communication means from the main fan outlet to the main fan inlet, for recirculating air to the main fan inlet, whereby as air is recirculated from the main fan outlet to the main fan inlet, correspondingly less air is drawn into the tank inlet, reducing the suction force at the tank inlet.

21. An electric vacuum cleaner, comprising:

a suction motor for moving air past itself;

a motor housing for containing the motor; the housing having a bottom, a top, an air inlet at the bottom and an air outlet;

a collecting tank for collecting materials drawn into the tank; the collecting tank having a bottom; an inlet into the bottom of the tank for entrance of air and collected materials to be sucked into and collected in the tank; first connecting means extending up from the tank; second connecting means at the bottom of the motor housing; the first and second connecting means being joined together for joining the tank and the motor housing;

air inlet height adjustment means for adjusting the height of the air inlet of the tank over a surface being suctioned; the height adjustment means comprising a respective wheel bearing at each lateral side of the tank and located near the tank air inlet; bearing support means on the tank for supporting each bearing at a predetermined location near the tank air inlet; the bearing being rotatable at the bearing support means for adjusting the orientation of he bearing with respect to the tank; means joining the bearings for enabling the bearings to rotate together; each wheel bearing including a support track thereon for a respective wheel, and the wheels being adapted for spinning about the tracks on the bearings; the wheel support track on each bearing being eccentric to the respective bearing, whereby rotation of the bearing adjusts the wheel orientation for adjusting the height of the tank air inlet.

22. The electric vacuum cleaner of claim 21, further comprising detent means for restraining rotation of the bearings at selected rotative orientations thereof, for establishing selected heights for the tank air inlet.

23. The electric vacuum cleaner of claim 22, further comprising a brush located to the rear of the tank air inlet for moving materials to the tank air inlet; a brush support plate for supporting the brush thereon and for extending forward on the tank past the wheel bearings; the brush support plate being fastened to the tank for being biased to serve as the detent means for the bearings.

24. The electric vacuum cleaner of claim 23, wherein the bearings include extensions of polygonal cross-section, and the means for joining the bearings are for joining the extensions thereof; the brush support plate engaging the extensions of the bearings.

25. The electric vacuum cleaner of claim 24, further comprising cooperating detent means on the tube and the bottom of the motor housing for establishing a plurality of circumferentially different arcuate swing arc sections for the motor housing with respect to the tank; the detent means obstructing swinging of the motor housing between the swing arc sections.

26. The electric vacuum cleaner of claim 25, wherein the detent means comprises two projections at spaced apart locations on the tube and comprising spring means in the motor housing and biased toward the tube for engaging the projections as the motor housing is swung, for thereby obstructing swinging of the spring past the projections as the spring engages each projection.

* * * * *